United States Patent [19]

Düeringer

[11] Patent Number: 4,771,617

[45] Date of Patent: Sep. 20, 1988

[54] PERMUTATION LOCK FOR CONTAINERS SUCH AS SUITCASES

[75] Inventor: Rudi Düeringer, Wuppertal, Fed. Rep. of Germany

[73] Assignee: S.Franzen Sohne (GmbH & Co.), Solingen, Fed. Rep. of Germany

[21] Appl. No.: 860,478

[22] Filed: May 7, 1986

[30] Foreign Application Priority Data

May 9, 1985 [DE] Fed. Rep. of Germany ..... 3516644

[51] Int. Cl.[4] ..... E05B 65/48

[52] U.S. Cl. ..... 70/74; 70/288; 70/304; 70/312; 70/315

[58] Field of Search ..... 70/69, 70–72, 70/74, 75, 77, 286–288, 312, 315, 304, 314

[56] References Cited

U.S. PATENT DOCUMENTS

| | | | |
|---|---|---|---|
| 101,632 | 4/1870 | Larry . | |
| 834,310 | 10/1906 | Lievens et al. . | |
| 2,382,756 | 8/1945 | Wagner et al. | 70/75 |
| 2,512,028 | 6/1950 | MacMillan . | |
| 2,664,738 | 1/1954 | Paganini . | |
| 2,912,844 | 11/1959 | Atkinson | 70/75 |
| 3,008,319 | 11/1961 | Cheney | 70/74 X |
| 3,008,320 | 11/1961 | Cheney | 70/74 |
| 3,411,330 | 11/1968 | Atkinson . | |
| 3,412,832 | 11/1968 | Jamison et al. | 70/70 X |
| 3,434,314 | 3/1969 | Atkinson | 70/312 X |
| 3,452,563 | 7/1969 | Atkinson | 70/312 |
| 3,646,787 | 3/1972 | Norrenberg-Sudhaus | 70/70 |
| 3,845,644 | 11/1974 | Lindner | 70/74 |
| 3,893,313 | 7/1975 | Kobayashi | 70/287 X |
| 4,155,234 | 5/1979 | Bako | 70/70 X |

FOREIGN PATENT DOCUMENTS

| | | |
|---|---|---|
| 1947557 | 12/1976 | Fed. Rep. of Germany . |
| 7690 | 11/1893 | Switzerland . |

*Primary Examiner*—Gary L. Smith
*Assistant Examiner*—Suzanne L. Dino
*Attorney, Agent, or Firm*—Burns, Doane, Swecker & Mathis

[57] ABSTRACT

A luggage lock comprises a hasp rotatably mounted to one container section, and a locking ledge carried by the other container section. A permutation locking mechanism is mounted on the hasp and comprises a plurality of manually rotatable adjusting disks, and a plurality of rotatable locking disks coupled to associated ones of the adjusting disks to be rotated thereby. Each locking disk includes a peripheral portion positioned behind the locking ledge when the locking disk is in an on-lock condition to prevent the hasp from being rotated to an open position. A code resetting mechanism enables the adjusting disks to be rotated relative to the locking disks to change the code.

7 Claims, 6 Drawing Sheets

Fig. 4
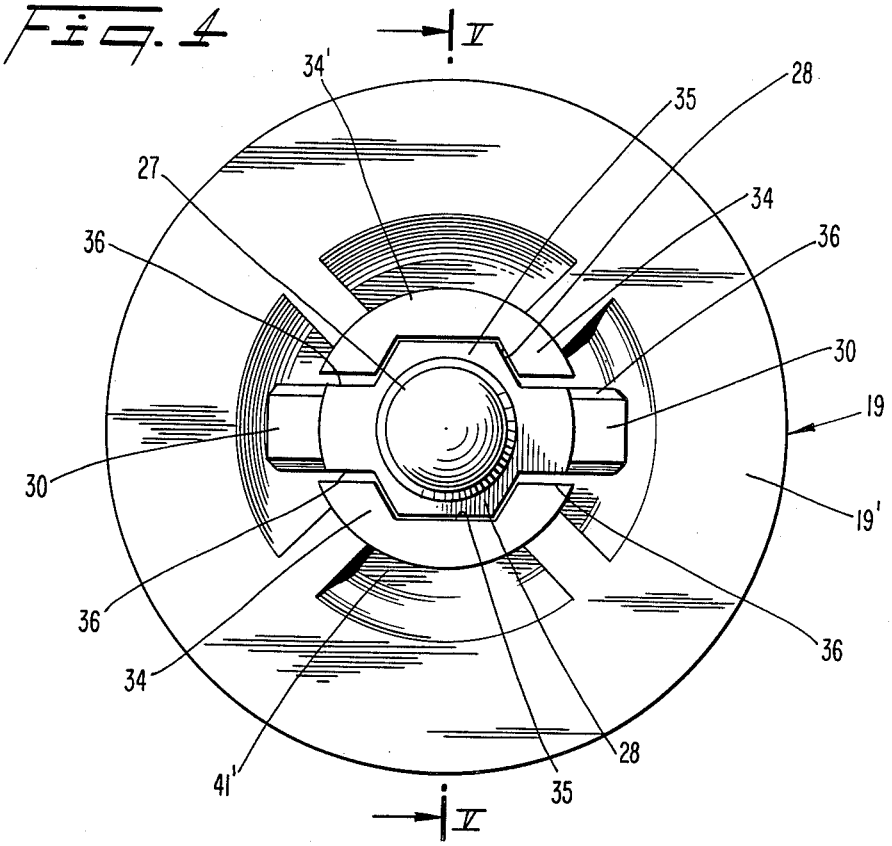
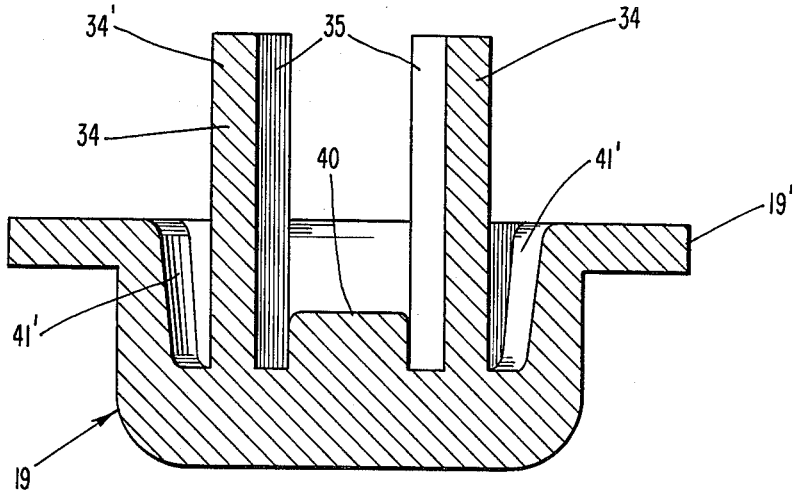
Fig. 5

PERMUTATION LOCK FOR CONTAINERS SUCH AS SUITCASES

BACKGROUND AND OBJECTS OF THE INVENTION

The present invention relates to a permutation lock for containers or cases such as suitcases, for example.

The lock is of the type which includes a hasp part pivotably supported on a base plate part and overlapping a counter-locking part. The hasp carries a permutation lock mechanism comprising a plurality of adjusting disks and a plurality of locking disks rotatable by means of the adjusting disks. The locking disks comprise peripheral portions on their circumference, the mutual alignment of which corresponds to the opening position of the secret code. A code resetting device enables the code to be changed.

In the known combination locks, the opening position set by the code is sensed by a linearly guided feeler slide which also forms a locking projection.

It is an object of the invention to structurally simplify a combination lock of this generic type, without reducing the security provided by its use.

SUMMARY OF THE INVENTION

These objects are achieved by the present invention which relates to a lock for containers such as luggage having first and second container sections. The lock comprises a first lock portion adapted to be mounted on one of the container sections and a second lock portion adapted to be mounted on the other container section. The first lock portion comprises a base plate and a hasp pivotably mounted thereto for rotation between an open position and a closed position overlapping the second lock portion. A permutation locking mechanism is carried by one of the first and second lock portions. A locking ledge is carried by the other of the first and second lock portions. The permutation locking mechanism comprises a plurality of manually rotatable adjusting disks arranged to be accessible to manual rotation. A plurality of rotatable locking disks is coupled to associated ones of the adjusting disks to be rotated thereby. Each of the locking disks includes a peripheral portion positioned behind the locking ledge when such locking disk is in an on-lock condition, to prevent the hasp from being rotated to an open position. The peripheral portion is moved from behind the locking ledge in an off-lock condition of the locking mechanism. A code resetting mechanism is provided for enabling the adjusting disk to be rotated relative to the locking disks to change the code.

As a result of that configuration, the lock is characterized by a structurally advantageous mechanism containing fewer parts. The locking disks themselves constitute the locking part, so that a feeler slide and its guides may be omitted. Overall, a more compact structural design of the lock is obtained. The sensing and locking function is performed by the already existing structural parts of the permutation lock. In actual fact, the arrangement is such that the locking disks in the on-lock position grip a locking ledge with their circumferential periphery.

Advantageously, the locking disks and the adjusting disks can be positioned in the hasp part of the permutation lock. The pivotability of such a hasp part raises the permutation mechanism from the wall of the suitcase or the like, so that, for example, the code resetting device may be actuated comfortably, the hasp part being accessible from both of the broad sides. This is more advantageous than effecting the resetting, for example, from the inside of the suitcase.

A very flat configuration of the hasp may be obtained in an advantageous manner by aligning each of the locking disks and the associated adjusting disk on an axle extending perpendicularly to the top side of the hasp part and transversely to its pivoting axle. In this manner, the height of the hasp part is no longer determined by the base diameter of the adjusting disks, etc.

The locking ridge has the configuration of a ledge protruding from the counter-locking part and entering a shaft on the bottom side of the hasp part. The latter is even able to absorb tensile stresses acting in the opening direction of the lid of the suitcase, so that the mechanism itself is free of stress. It is also advantageous in this context to provide the ledge in the form of an angle.

The angular position of the adjusting disk and the locking disk can be varied with respect to each other after the depression of a coding piece which is accessible from the bottom side of the hasp piece. In that depressed position, obtained against spring pressure, the adjusting disk and the locking disk are disconnected. The hasp part itself covers the zone accessible for the changing of the code when the suitcase is closed.

An advantageous double function in relation to the coupling means is achieved wherein the locking disks also serve as the locking notches for the positioning of the rotational settings, by means of the contact notches entered by the coupling projections of the coding piece, to connect with the adjusting disks. An advantageous variant in relation to the locking ledge involves forming the latter as the bottom side of the counterlocking part, which comprises an opening for the partial passage of the locking disks and the bayonet catch-like grip of the circumferential periphery of the locking disk. Since in this configuration the free-standing end of the coding piece is covered, any accessibility of the coding piece is prevented.

To facilitate the rotating setting of the adjusting disks, they are designed as polygonal plates with their upper sides located parallel to the top side of the hasp part. It is advantageous to provide the hasp part with an intermediate locking position aligned obliquely toward the rear. The resetting of the code is rendered easier by this measure. A holding tongue overlapping the closure gap, originating in the base plate part and engaging a recess of the counter-locking part with the lid of the suitcase closed, serves to keep stresses from acting on the mechanism of the permutation lock. Forces acting on the two lock forming parts are transmitted to the stable base plates.

BRIEF DESCRIPTION OF THE DRAWING

The invention is explained below in more detail by means of two preferred embodiments with reference to the drawings attached hereto. In the drawings:

FIG. 4 is a bottom view of an adjusting disk, significantly enlarged, with a coding piece inserted;

FIG. 5 is a section taken along line V—V in FIG. 4, without the coding piece;

DETAILED DESCRIPTION OF THE PREFERRED EMBODIMENTS OF THE INVENTION

A first preferred embodiment of the invention will initially be described below with reference to FIGS. 1, 2, 4, 5, 6 and 7. Then, a second preferred embodiment will be described with reference to FIGS. 3, 8, 9 and 10.

Figure 1:
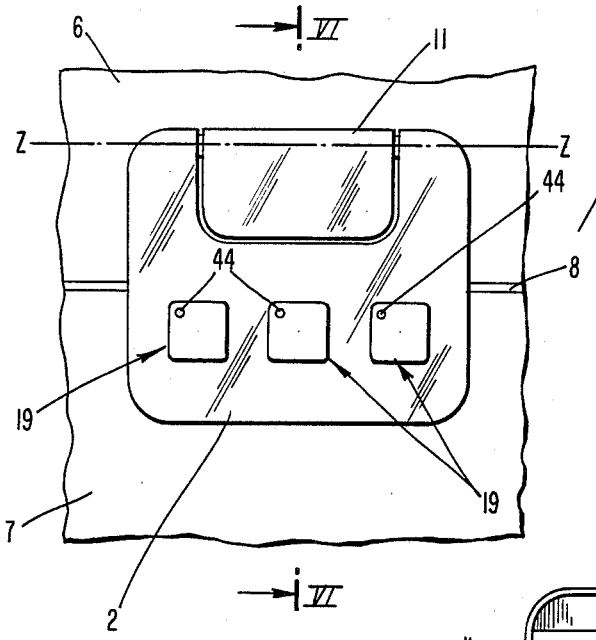
FIG. 1 is a top plan view of the permutation lock mounted across the closing gap between a lid and the lower part of a suitcase, according to a first embodiment of the invention.
Figure 2:
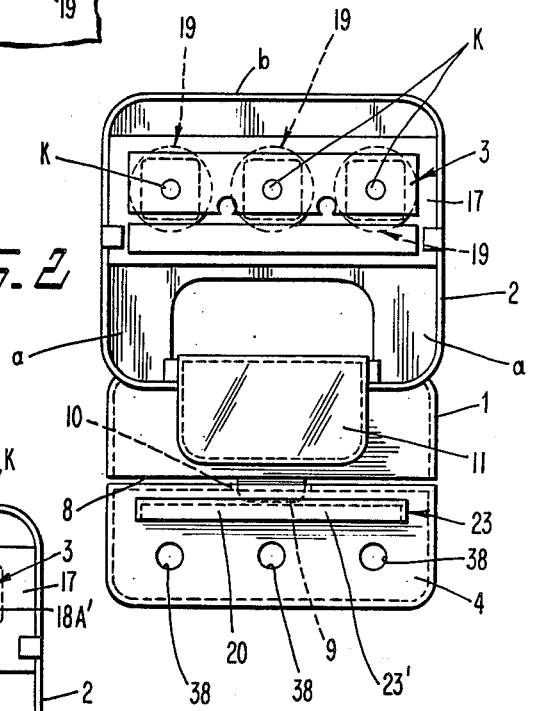
FIG. 2 is a top plan view corresponding to FIG. 1, but with the hasp part tilted into the opening position.
Figure 6:
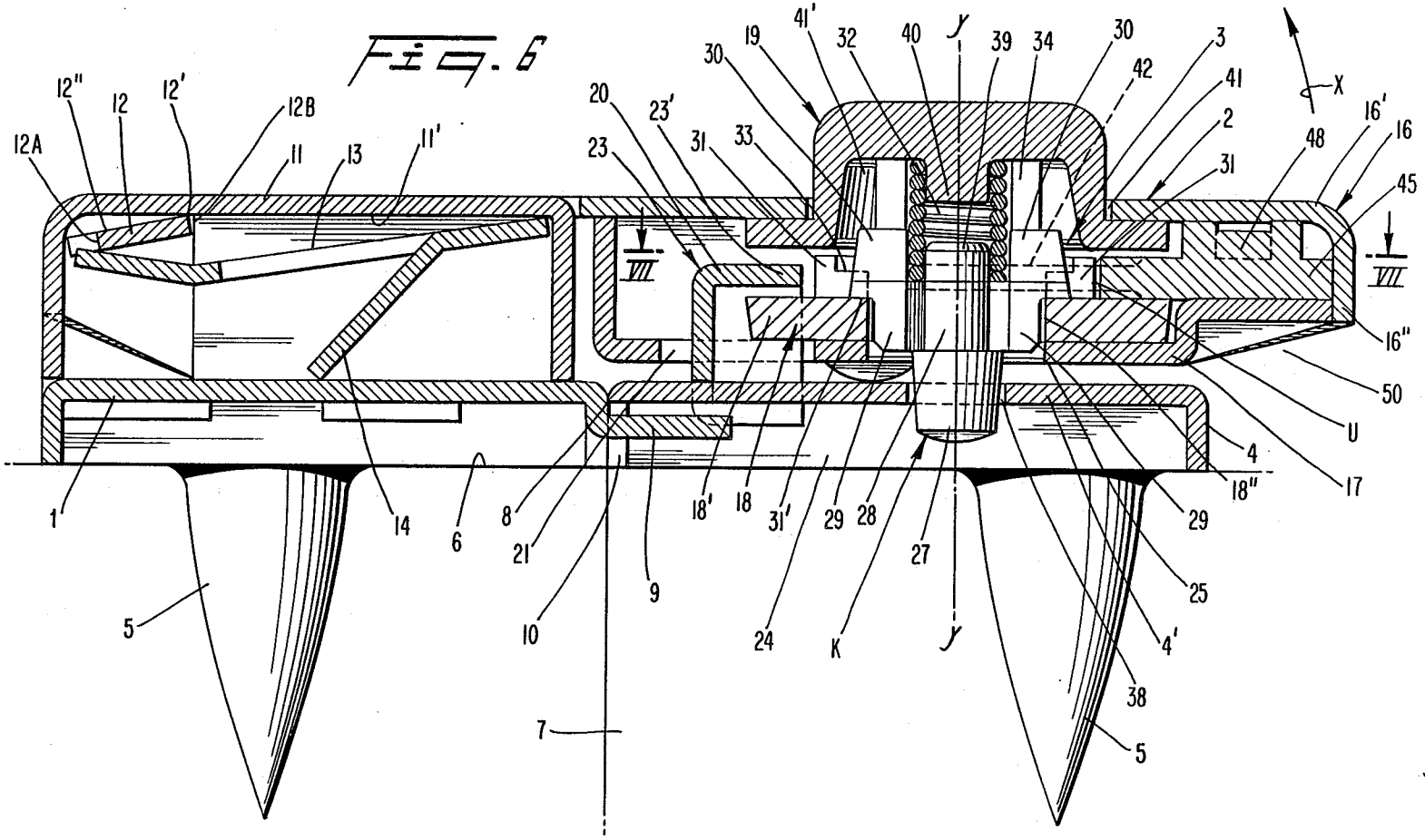
FIG. 6 is an enlarged cross-section taken along line VI—VI in FIG. 1.

A permutation lock according to the present invention comprises a base plate part 1, and a hasp part 2 mounted thereon to be pivotable around an axis z—z (see FIGS. 1, 2, 6). The hasp part 2 contains a permutation mechanism 3 and overlaps a counter-locking part 4.

The base plate 1 is fastened by means of staples 5 to a wall of a lid 6 of a suitcase. The counter-locking part 4 is mounted on a wall of a bottom part 7 of the suitcase.

An insertion tongue 9 of the base plate 1 overlaps a closing gap 8 between the two parts or halves of the suitcase and serves to centeringly align the base plate 1 and the counter-locking part 4. The tongue 9 originates on the base plate 1 and protrudes, in the closed state of the lid 6, into a suitable recess 10 of the counter-locking part 4. Lateral edges of the tongue converge in the direction of the insertion (see FIG. 2).

The hasp part 2 is articulated along a longitudinal edge of the basically rectangular base plate 1 located opposite the tongue 9. The hasp part 2 is hinged to a small box 11 projecting above the top of the base plate. The box 11 consists, as does the base plate 1, of a stamped sheet metal part and is connected to the base plate by means of holding tongues which are secured in slots in the base plate 1. The box 11 is slightly recessed away from the longitudinal edge of the base plate from which the tongue 9 projects. The area of the base plate not covered by the box 11 is fully covered by the closed hasp part 2. Accordingly, the latter is U-shaped and includes two parallel legs a.

The legs a carry axle tabs 12 which extend into the box 11 and form the pivot axle z—z of the hasp part 2. The inside of the box 11 contains a leaf spring 13 which is supported at three different points and which stresses the axle tabs 12 such that, in its closed position (FIG. 1) the hasp part is biased toward the base plate 1. The open position of the lock is shown in FIG. 2 wherein the unlocked hasp part 2 has been rotated almost 180°. A locking condition of the lock is depicted in FIG. 6. When unlocked, the hasp can be rotated to an intermediate position wherein it is upright (not shown). In this position the axle tabs 12 are loaded by the flat spring 13 which bears against a narrow frontal end 12A of the tabs. The other narrow rear end 12B abuts against the bottom side 11′ of the box.

The flat spring 13 includes a finger 14 cantilevered along one edge and presses against the top side of the base plate 1 covered by the box 11. The reaction force acting against the finger 14 is such that the axle tabs 12, as seen in FIG. 6, are pressed yieldably against the bottom side 11′ of the cover of the box 11. Also, an edge 12′ of the tab 12 facing the counter-locking part 4 rests against the bottom side 11′ and defines, in effect, the pivoting point of a two-arm lever of the hasp. The diagonally opposite edge 12″ of the tab absorbs the spring load and is located at a slight distance from the lug cover.

The permutation mechanism 3 is located in a bight portion b of the hasp part 2. This bight b is approximately twice as wide as each leg a. The segment of the closed hasp part 2 covering the counter-locking part 4 forms a flat lock housing 16 (FIG. 6). The housing 16 includes a cover 16′ and skirt walls 16″. A bent plate 17 forms a bottom of the lock housing 16.

The permutation mechanism 3 located in the lock housing 16 comprises three rotatingly mounted locking disks 18 (FIGS. 6, 7) placed in a row adjacent to each other, with a cup-shaped adjusting disk 19 being operably connected to each of them for their actuation. The locking disks are identical, and one of them is depicted in greater detail in FIG. 5.

In the on-lock position, a circumferential periphery 18′ of each locking disk underlies a leg 23′ of a locking ledge 20, the locking ledge 20 being joined fixedly to the wall of the bottom part 7 of the suitcase.

The locking ledge 20 comprises a strip 23 projecting from the counter-locking part 4 and passing through a hole 21 in the bottom side of the hasp part 2, the hole being formed in the bottom 17. The ledge 20 is shaped as a right-angle strip 23 fastened by means of holding tongues to the counter-locking part 4. The tongues pass through slits in the counter-locking part 4 and are bent in the rear of the counter locking part 4. The counter-locking part 4 forms a cavity 24 on a side of the wall of the suitcase 7. As seen in FIG. 2, the strip 23 extends substantially the entire length of a rectangular base of the counter-locking part 4, so that the circumferential peripheries 18′ of all of the three locking disks 18 arranged in a row are able to be simultaneously disposed under the leg 23′ of the angled strip which extends parallel to the top side of the counter-locking part 4 (FIG. 6).

Figure 7:
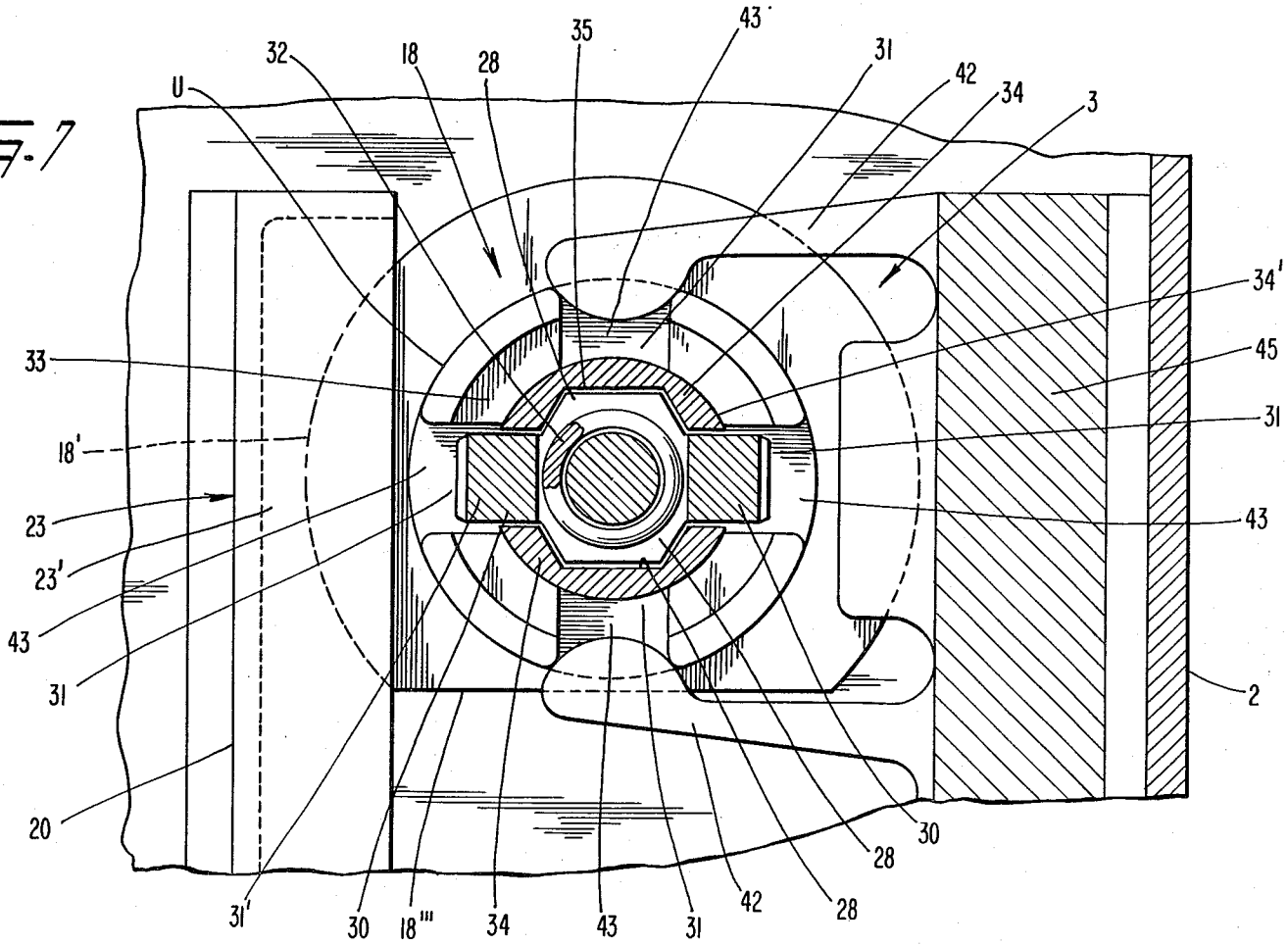
FIG. 7 is a partial sectional view taken alone line VII—VII in FIG. 6.

Each locking disk 18 includes a flattened edge 18‴ (FIG. 7). When that edge 18‴ is located parallel to the frontal wall of the leg 23′, the hasp part can be pivoted up in the direction of the arrow x against the pressure of the spring 13.

The locking disk 18 and the associated adjusting disk 19 are rotatable about an axis y—y which projects perpendicularly to the top side of the hasp part 2 and thus is oriented orthogonally relative to the rotary axis z—z of the hasp part. A coupling member or coding piece K is mounted in the locking disk 18 and is displaceable in an axially limited manner. A lower end 27 of the coding piece on the side of the counter-locking part 4 forms an actuating knob. Integral with the knob 27 and disposed thereabove is a polygonal part 28 (see FIGS. 6, 7) which includes diametrically opposed wings or guide strips 29. The locking disk 18 comprises a circular center passage 18″ through which the polygonal part 28 extends. Upper portions of the wings 29 form ledges which overlie the disk 18, as can be seen in FIG. 6. The wings 29 carry upwardly extending projections 30 which include radial noses 31' seated in a pair of diametrically opposed recesses 31 located in a circular collar portion U of the locking disk 18. The noses 31' interconnect the coding piece K and the locking disk 18 for simultaneous rotational movement. This connection is released only when the coding piece K is raised, against the force of a return spring 32, so that the noses 31' are lifted out of a coupling position in which they rest on the top side of the locking disk 18 (i.e., on the bottoms of the engaging recesses 31) to an uncoupling position disposed at least to the level of a circular shoulder 33 of the collar of the locking disk. At this point, the adjusting disk 19 may be rotated along with the coding piece K to become engaged with another pair of diametrically opposed recesses 31 with the coupling projections 30 entering the new recesses under the pressure of the spring 32, upon the release of the actuating knob 27.

The adjusting disk 19 includes integrally molded fork-like fingers 34 which extend diametrically opposed to each other (FIG. 5). Their radially outer surfaces 34' are cylindrical, thereby forming an angle during rotation of the adjusting disk 19 relative to the locking disk 18 when the code is being changed. The inner sides 35 of the fingers comprise trapezoidal notches 35 which establish a positive joint with the polygonal part 28 of the coding piece K (see FIG. 7), together with shafts 36 following in the radial direction for the wings 29.

The cover 4' of the counter-locking part 4 comprises an opening 38 through which the actuating knob 27 passes.

Between the two coupling projections 30 is disposed a pin 39 pointing toward the adjusting disk 19. The pin 39 cooperates with a pin 40 of the adjusting disk 19. The two pins 39, 40 act as holders for the terminal windings of the resetting spring 32, which is in the form of a helical compression spring. The distance between the outer surfaces of the pins 39, 40 is slightly larger than the disconnecting stroke of the coding piece K.

To create the necessary escape space 41' for the upward axial displacement of the coding piece K relative to the locking disk 18, the adjusting disk 19 has a hat-like configuration. The exposed portion of the disk 19 may have a rectangular configuration (see FIG. 1), whereas the portion thereof passing through an opening 41 in the hasp cover 16' is circular. The lower edge 19' of the disk extends beneath the hasp cover to prevent dislodgement of the disk.

As is apparent from FIG. 7, the code resetting device is adjusted for four setting steps of equal angles by means of cross-slits defined by the recesses 31. The four basic prevailing positions are yieldably retained by prestressed spring fingers 42. The heads of those fingers are rounded off transversely, as are the radial ends of the recesses 31, so that these radial ends form locking notches 43 for receiving the heads of the spring fingers. The spring fingers 42 act on the diametrically opposing circumferential zones of the circular collar U of the part of the locking disk involved. The locking spring fingers 42 originate from a common strip 45, which is held between the hasp cover 16' and the bottom 17 of the hasp part 2. For accurate positioning, alignment pins may be molded onto the strip, which are seated in alignment bores of the bottom 17 (e.g., see the pin 46 and bore 47 of the second embodiment depicted in FIG. 8). In its terminal areas the strip comprises notches 48 for receiving holding tongues of the cover of the hasp part 2.

The polygonal cover plate of the adjusting disks 19 carries a marking point 44, in the form of a button or a recess, respectively. The position of the points forms the code (for example, upper right, lower left, lower right) for persons entrusted with it.

The operation of the permutation lock is as follows: the code, known to those entrusted with it, is set by rotating the adjusting disks 19. In so doing, the locking disks 18 occupy an angular position in which the flats 18''' are opposed to the locking ledge 20. The hasp part may then be raised in the direction of the arrow x. As seen in FIG. 6, the frontal edge of the hasp part 2 may be gripped well because of the shortened configuration of the counter-locking part. The bottom side of the lock case is inclined toward the rear in an obliquely ascending manner to define a gripping space 50.

The closing of the permutation lock also requires that the code be set in its unlocking mode. The lock is re-set to an on-lock mode by the displacement of at least one adjusting disk by an angle 90° into the next locking position.

To change the code, the coding piece K is depressed toward the adjusting disk 19 against the spring 32 relative to the adjusting disk 18. In the process, the coupling projections 31' of the coding piece K leave the corresponding recesses 31 of the locking disk 18. By rotating the adjusting disk 19, the latter may be displaced with respect to the stationary locking disk 18. When the desired angular position is attained, the reset spring 32 again effects the coupling of the afore-mentioned functional part, upon the release of the coding piece K.

Figure 8:
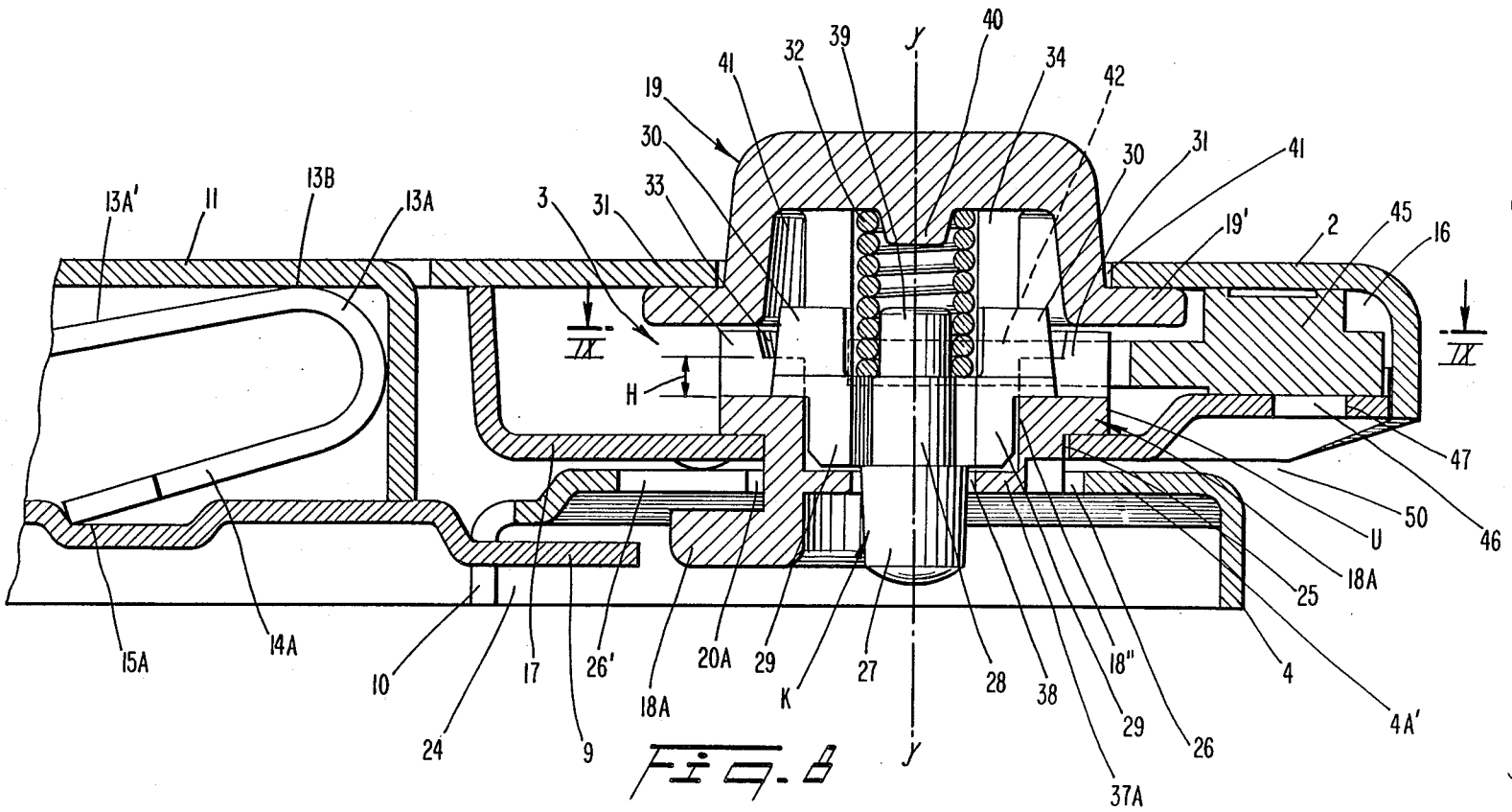
FIG. 8 is a cross-section taken through the permutation lock according to the second embodiment, in the ready-to-open position.
Figure 9:
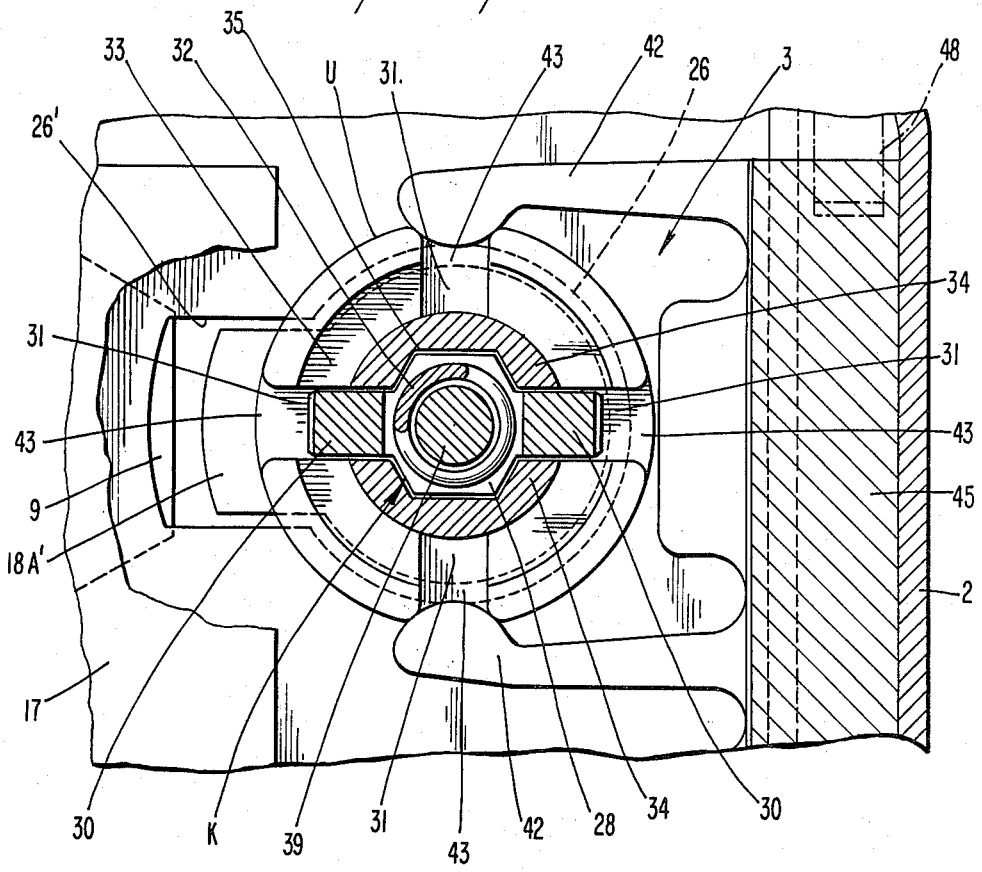
FIG. 9 is a section taken along the line IX—IX in FIG. 8.
Figure 10:
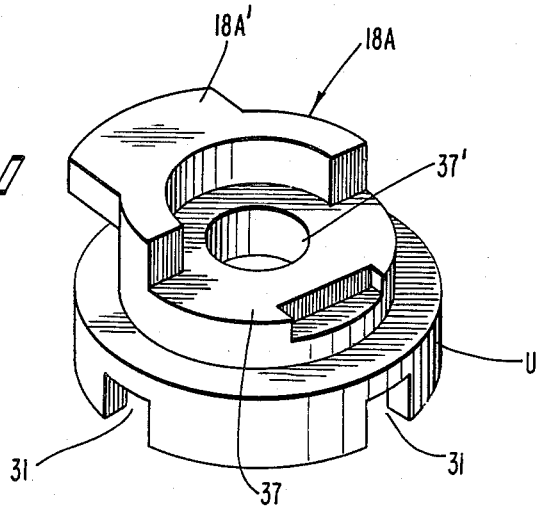
FIG. 10 depicts the locking disk of the second embodiment in perspective.

Another preferred embodiment of the invention, depicted in FIGS. 3 and 8–10, is basically similar to the earlier disclosed embodiment. However, the leaf spring for urging the hasp in its various positions comprises a spring 13A bent into a generally U-shape (FIG. 8). A shorter leg 14A of the spring bears against the bottom of the spring chamber within a cavity 15A of the base plate, such that the end of the leg 14A bears against a corner of that cavity 15A. The bight portion of the spring bears against a top part of the box 11 at 13B. The remainder of the spring is as depicted in FIG. 6.

Figure 3:
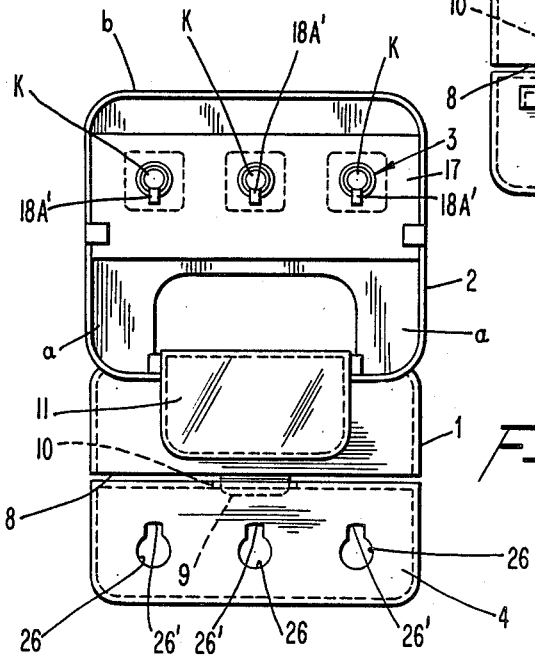
FIG. 3 is a top plan view of a permutation lock according to a second embodiment in the opening position.

The locking ledge 20A is defined by a portion of the cover 4A' of the counter-locking part which contains a keyhole shaped hole 26 (FIG. 3). The locking disk 18A contains a projection 18A' which is adapted to pass through an enlarged portion 26' of the hole 26. When the locking disk 18A is rotated such that the projection 18A underlies the locking ledge 20A, the hasp is locked and cannot be raised. The locking disk 18A includes a hole 37' (FIG. 10) into which the knob 27 can be mounted. The bottom 37 of the locking disk is coplanar with the cover 4A' of the counter-locking part 4.

It is possible to situate the permutation lock in the counter-locking part 4 and to situate the locking ledge 20 in the hasp, although it is more preferable to mount the lock in the hasp as described in the foregoing embodiments to minimize the size of the lock and facilitate re-setting the code.

Although the present invention has been described in connection with preferred embodiments thereof, it will be appreciated by those skilled in the art that additions, modifications, substitutions and deletions not specifically described, may be made without departing from the spirit and scope of the invention as defined in the appended claims.

What I claim is:

1. A lock for containers such as luggage having first and second container sections, said lock comprising a first lock portion adapted to be mounted on one of said container sections and a second lock portion adapted to be mounted on the other of said container sections, said first lock portion comprising a hasp pivotally mounted on rotation between an open position and a closed position overlapping said second lock portion, a permutation locking means carried by said hasp, and a locking ledge carried by said second lock portion, said permutation locking means comprising:

a plurality of manually rotatable cup-shaped adjusting disks arranged to be accessible to manual rotation about a plurality of parallel axes, each said adjusting disk including an internal space, a plurality of rotatable locking disks associated with respective ones of said adjusting disks to be rotated thereby about said axes, each locking disk arranged to oppose said internal space of its associated adjusting disk and including a peripheral portion positioned behind said locking ledge when such locking disk is in an on-lock condition to prevent said hasp from being rotated to an open position, said peripheral portion being moved from behind said locking ledge in an off-lock condition of said locking means when said adjusting disks are arranged in accordance with a secret code, a plurality of coupling members each interconnecting one of said adjusting disks with its associated locking disks for common rotation whereby rotation of said adjusting disk produces rotation of its associated locking disk, said coupling member being movable relative to its associated locking disk and adjusting disk along the axis of rotation of the latter and within said internal space to uncouple said adjusting disk from said locking disk and permit relative rotation therebetween for changing the secret code, said coupling member including an actuating knob which is accessible for manual depression when said hasp is in said open position to enable said coupling member to be pushed into said internal space, and a plurality of spring means arranged to yieldably bias said coupling members toward a position coupling said adjusting disks with their respective locking disks.

2. A lock according to claim 1, wherein said axes of rotation of said adjusting disks are oriented orthogonally relative to an axis about which said hasp pivots between said open and closed positions.

3. A lock according to claim 1, wherein said hasp comprises a housing having top and bottom plates defining an internal area containing said locking disks, said bottom plate including a recess through which said locking ledge enters said area when said hasp is closed.

4. A lock according to claim 3, wherein said locking ledge comprises a bent strip.

5. A lock according to claim 1, wherein each locking disk includes a plurality of circumferentially spaced locking notches, each coupling member including projections receivable selectively in said locking notches.

6. A lock according to claim 1, wherein said adjusting disks include a polygonal outer surface.

7. A lock according to claim 1, wherein said base plate includes an insertion tongue extending across a parting line between said container sections, said second lock portion including a recess in which said tongue is received.

* * * * *